United States Patent [19]

Bowser et al.

[11] Patent Number: 4,840,377

[45] Date of Patent: Jun. 20, 1989

[54] ELECTRICAL TAPE BOUNDARY SENSOR APPARATUS

[75] Inventors: C. Frederick Bowser, 121 E. Church St., Homer City, Pa. 15748; John L. Kurtz, Indiana, Pa.

[73] Assignee: C. Frederick Bowser, Homer City, Pa.

[21] Appl. No.: 132,586

[22] Filed: Dec. 14, 1987

[51] Int. Cl.[4] ..... A63B 61/00

[52] U.S. Cl. ..... 273/31; 340/323 R

[58] Field of Search ..... 273/31; 340/323 R; 73/DIG. 4, 862.53, 862.68

[56] References Cited

U.S. PATENT DOCUMENTS

| | | | |
|---|---|---|---|
| 3,415,517 | 12/1968 | Krist . | |
| 3,774,194 | 11/1973 | Jokay et al. . | |
| 3,868,667 | 2/1975 | Skujins, Jr. | 73/DIG. 4 |
| 3,883,860 | 5/1975 | von Kohorn . | |
| 3,982,759 | 9/1976 | Grant . | |
| 4,004,805 | 1/1977 | Chen et al. . | |
| 4,062,008 | 12/1977 | Carlsson et al. . | |
| 4,092,634 | 5/1978 | von Kohorn . | |
| 4,109,911 | 8/1978 | Van Auken . | |
| 4,365,805 | 12/1982 | Levine . | |
| 4,375,289 | 3/1983 | Schmall et al. . | |
| 4,422,647 | 12/1983 | Wilson et al. . | |
| 4,432,058 | 2/1984 | Supran . | |
| 4,664,376 | 5/1987 | Gray . | |

*Primary Examiner*—Leo P. Picard

*Attorney, Agent, or Firm*—Webb, Burden, Ziesenheim & Webb

[57] ABSTRACT

A system is provided that analyzes the output voltage caused by the impact of an object, particularly a tennis ball, relative to a boundry line. It combines sensors mounted on a tennis court's surface with computer graphics and data acquisition software that indicates to a tennis umpire, line judge or player that the ball or other object has struck a boundary line.

5 Claims, 3 Drawing Sheets

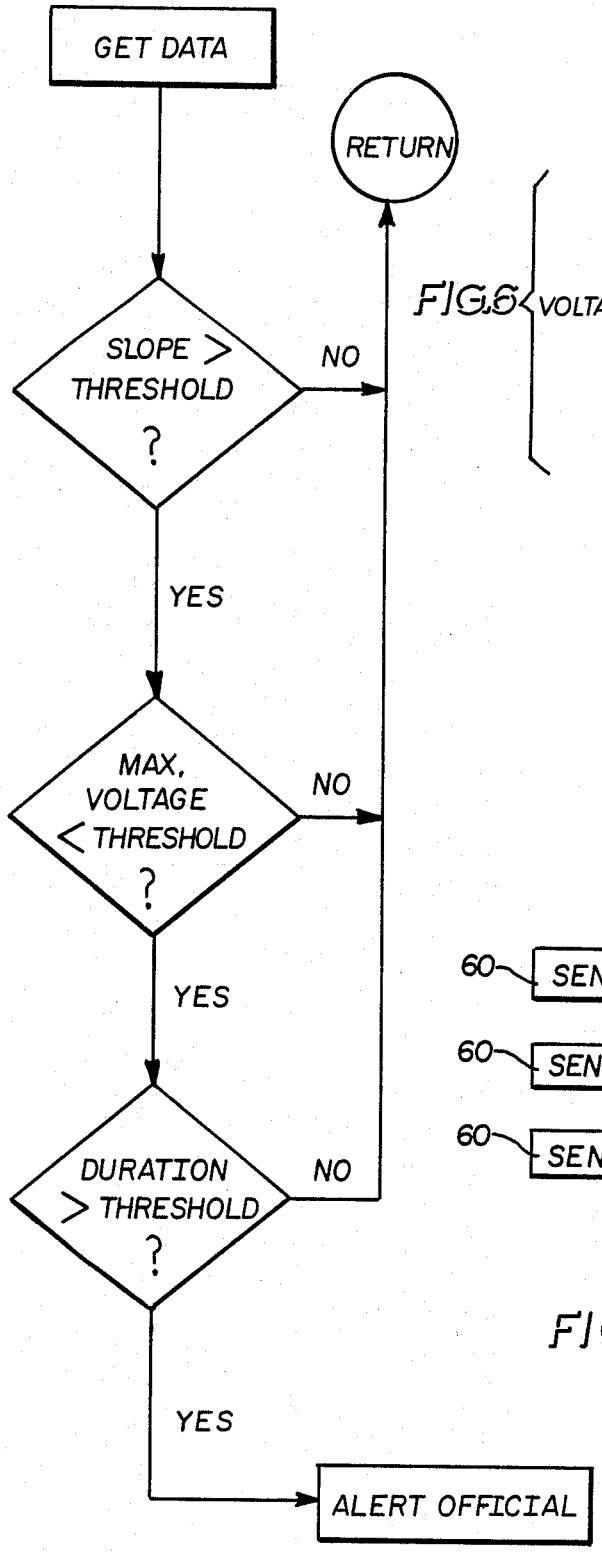
FIG. 7
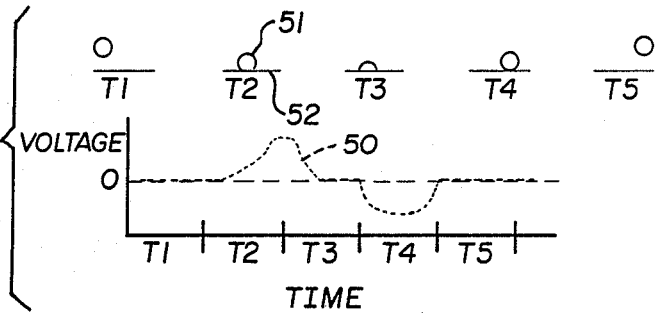
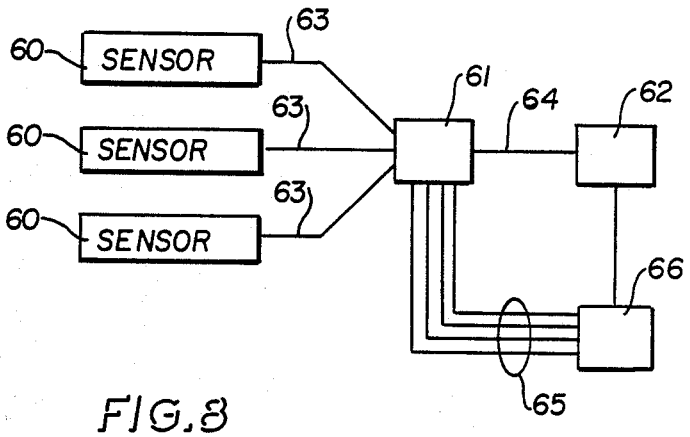
FIG. 8

ELECTRICAL TAPE BOUNDARY SENSOR APPARATUS

BACKGROUND OF THE INVENTION

1. Field of the Invention

The present invention relates to an apparatus for monitoring a boundary; more specifically for detecting whether or not a ball or foot has hit a line on a game court.

2. Description of the Prior Art

In tennis, like many other sporting events having boundaries of play, judgement calls must be made continually as to whether events have taken place "in" or "out" of the boundary. In which involves ball velocities of 100 miles per hour or greater, such judgement calls are extremely difficult because of the inherent inability of the human eye to follow an object moving at such a speed, and relate the relative position of impact on or over a line. Such calls are further complicated by the fact that a tennis ball often slides or rolls several inches on the ground before rebounding into the air adjacent the court surface.

Prior to this time, a number of devices have been proposed which replace human judgement with a mechanical or optical sensor. The shortcomings of these devices, however, have prevented the widespread acceptance of any of these devices. Many of the previous devices require modification of the ball to plot its position relative to electrical conductors provided beneath the court and or its boundaries. This may be unacceptable in regulation play, and greatly increases the cost of tennis balls and of modifying existing courts.

A second type of device is one which is laid on the playing surface and senses the impact of the ball or player on the critical boundary. Prior to the present invention, these sensors were made of materials not well suited to withstand the strain of multiple impacts over a long period of time. For example, in U.S. Pat. No. 4,365,805, a pressure switch, known as a "membrane" switch is comprised of foil conductors separated by a dielectric with holes. The weight of the impact presses the foil together within holes formed in the dielectric material. The switches depend on plastic deformation of the conductors. Repeated deformations of this type, particularly under heavy pressure, tend to stretch the conductors, which over time may cause an electrical failure. Typically, the onset of failure is indicated by intermittent or multiple switching contacts per actual impact on the sensing device. This unreliability over time is unacceptable.

Finally, a serious problem is "shadowing." This is the masking of one impact by another. For example, if a foot is already on the line when the ball hits, the sensor must be able to still detect the second impact, even if the two events are quite close together or simultaneous.

Prior to the present invention, there has been no comprehensive solution to these problems.

SUMMARY OF THE INVENTION

The tape boundary sensor apparatus operates by placing a plurality of elongated piezoelectric sensors directly over the boundary lines with the top of the sensors being substantially flush with the playing surface. A flexible colored tape which reproduces the boundary line and background over the sensor may be adhered to the court on top of each sensor. Alternatively, the boundary colors may be painted directly onto the sensor material. Each boundary line of the court has at least one separately monitored sensor. Each sensor may be provided in any desired length and by increasing the number of sensors on any boundary line, increased locational resolution of an impact on the boundary line is obtained. The sensors are electrically connected to a signalling device, such as a computer which preferably provides a visual display of each boundary impact on the playing field or court. The computer also provides a clock for the timing of the impacts on the sensor.

The sensors contain piezoelectric film conductors, which provide a continuous contact area located on the boundary area. Upon impact by some object, particularly a tennis ball, a signal is generated by the sensor. The invention includes signal conditioning circuitry for accurately sensing the impact on the conductors. Since the piezo film is both piezoelectric (sensing impact and creating a voltage) and pyroelectric (sensing heat and creating a voltage), the signal from the sensor may fluctuate randomly due to temperature changes. The signal conditioning circuit accounts for and eliminates these fluctuations. Similarly, a control sensor, located outside the playing field, may be used to normalize the baseline readings of the sensors at all times.

Once the signal has left the conditioning circuitry, it enters an Analog to Digital converter, or A/D converter. The several sensors are multiplexed to allow multiple sensors to be utilized with one converter. An example of an A/D converter is the National Semiconductor Chip No. ADC 1210. The magnitude of the analog voltage input from the sensor is transformed into a proportional digital word. One embodiment utilizes an A/D converter operating at 10 MHz, indicating that 10,000 samples of the analog signal are evaluated and stored every second.

The data from the converter is then ready to be processed by the computer to determine whether a ball or other object, such as a foot has come into contact With the sensor. There are three factors which will influence the waveform shape of the sensor output. These are surface area of the impact, force of the impact and duration of the impact.

The slope of the rise of the impact waveform is checked first. This is accomplished by subtracting the zero point voltage (the baseline voltage) from successive points to get a measure of the slope of the line, i.e. the change in voltage over time. A slope less than a pre-set threshold would be rejected as a non-ball impact. The slope is a measure of how much surface area of the sensor is depressed, with a steep slope indicating a small impact area, and a gradual rise indicating a larger impact area. This is actually a measure of changes in capacitance of the sensor, since capacitance is diminished by impact, and a larger impact decreases capacitance proportionately.

The computer next analyzes the waveform for the peak voltage. An impact from a ball has a maximum peak voltage, and any reading above this would immediately be rejected.

The final analysis is of the time of impact. This is a final confirmation of a ball impact. A foot necessarily stays on the sensor for a longer period of time, and if the time of impact is greater than a pre-set threshold, no confirmation of a ball impact will be given.

Since the system measures changes in voltage as a function of time, if a ball hits the line while a foot is currently on the sensor, the resulting spike will still be detected by the computer, even though the baseline voltage was not at the normal minimum.

One additional embodiment of the present invention allows for the placement of a sensor on the net. This allows the official to determine more accurately if the ball has grazed the top of the net during play.

The results are then displayed on an indicator connected to the computer to provide a perceptible indication that a particular event has occurred.

These and other advantages and features of the present invention will be more fully understood on reference to the presently preferred embodiments thereof and to the appended drawings.

BRIEF DESCRIPTION OF THE DRAWINGS

FIG. 6 is a plot of the voltage output of a sensor during the impact of an object.

FIG. 7 is a logic flowchart of the impact analysis circuitry.

FIG. 8 is a block diagram of the entire circuitry.

DESCRIPTION OF THE PREFERRED EMBODIMENTS

Figure 1A:
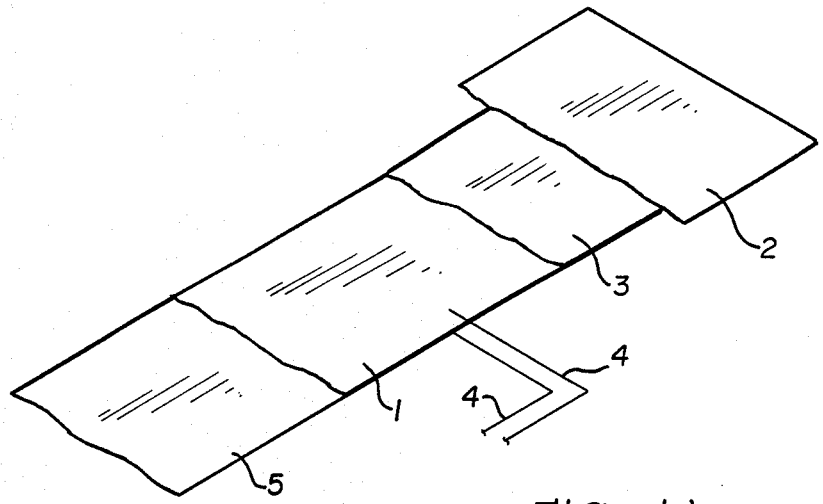
FIG. 1*a* is an isometric drawing of a boundary line with a sensor affixed thereto.

Referring to FIG. 1*a*, the sensor means of the present invention are structurally composed of plural, elongated, piezoelectric conductors 1. Conductors may have a width equal to the width of boundary line 5, as shown, or the sensor means may include a number of narrow longitudinally extending parallel conductors spaced across the width of the boundary line 5. The sensor means are sealed and waterproof and may have a covering such as a layer of tape 2 or paint 3 in the top side to indicate the boundary line. Electric output leads 4 extend from inside the sensor. The sensor is placed directly on the existing boundary line 5 of the tennis court.

Figure 1B:
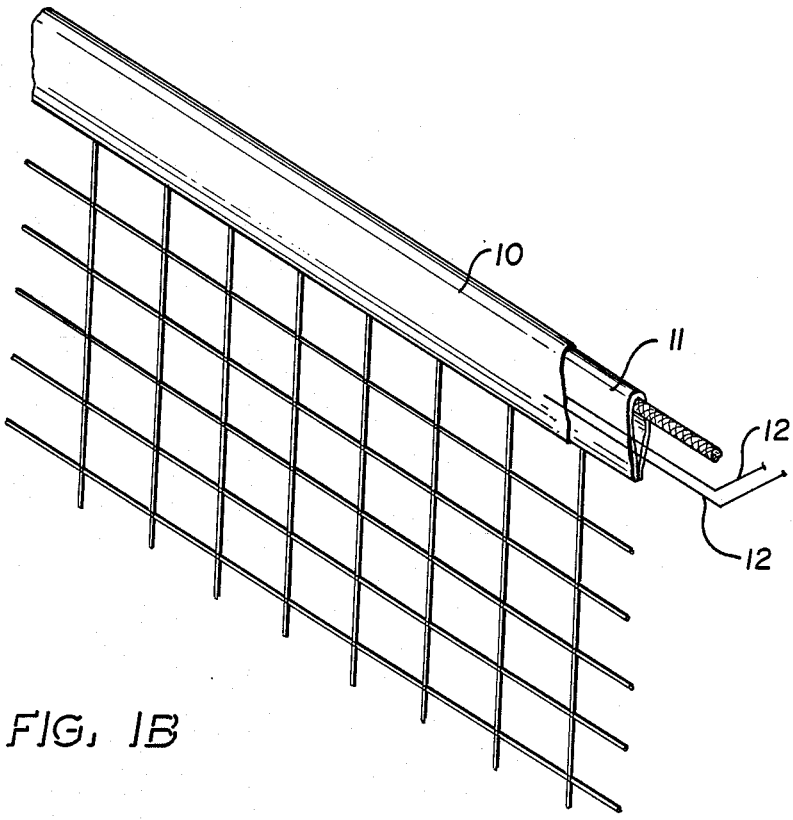
FIG. 1*b* is an isometric drawing of the top section of a tennis net with a sensor affixed thereto.

Referring to FIG. 1*b*, the sensor 10 may be placed along the top of the tennis net 11 to determine whether a ball has grazed the top of the net. Electric leads 12 extend from the sensor to the rest of the circuitry.

Figure 2:
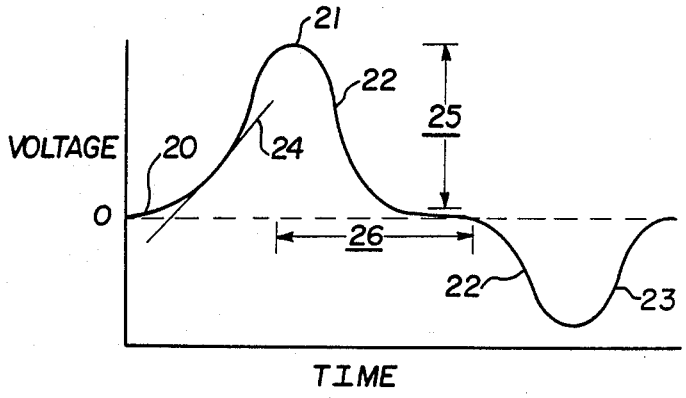
FIG. 2 is a plot of voltage v. time of an impact on a sensor of the present invention.

As shown in FIG. 2, which graphically illustrates the changes in voltage output by the sensor during an impact, a waveform is produced having an initial rise 20, a crest 21, a decline 22, and a subsequent rise 23 to a baseline reading. The initial rise indicates the slope 24 of the wave, measured by the change in voltage per unit time. The peak voltage 25 measures the force of the impact, and the duration of the impact 26 is measured between two predetermined points on the wave.

Figure 3:
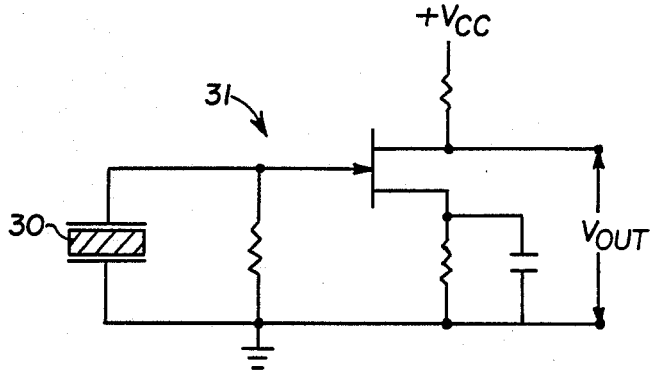
FIG. 3 is a schematic block diagram of the conditioning circuitry of the present invention.

Referring to FIG. 3, the sensors 30 are connected electronically to signal conditioning circuitry 31. This is utilized to eliminate unwanted signals and fluctuations in actual readings. Piezo film is both piezo- and pyroelectric, sensing both impact and heat changes, and converting this energy into electrical impulses. The conditioning circuitry filters fluctuations in signal and increases the signal-to-noise ratio. One method used to accomplish this is to wire two equal sections the sensor out of phase, which will cancel all unwanted noise in only one of the sensor areas.

Figure 4:
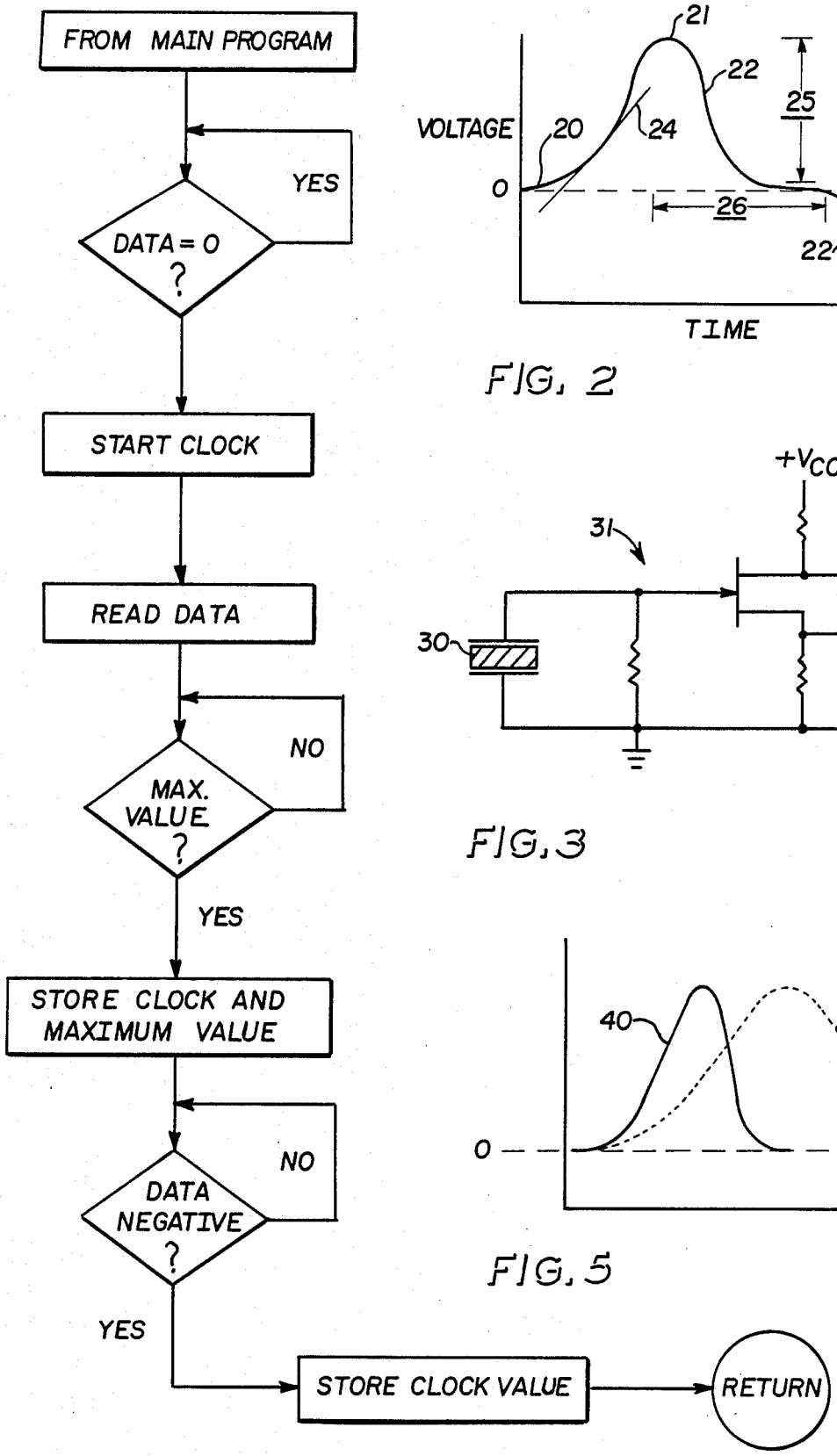
FIG. 4 is a logic flowchart of the data acquisition circuitry.

Referring to FIG. 4, the logic for determining the maximum voltage and storing the information is illustrated. The decision making process is shown as a pathway of binary decisions.

Figure 5:
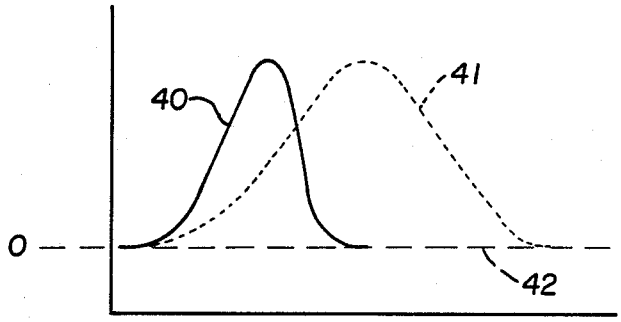
FIG. 5 is a plot showing two different surface area impacts on the sensor.

FIG. 5 illustrates the different waveforms produced by impacts on the sensor having different surface areas. A steeper slope 40 is compared to a more gradual slope 41. The baseline 42 is indicated as the zero point for calculations.

Changes in voltage 50 output by the sensor are illustrated by FIG. 6. Here, a ball 51 in contact with court 52 is interposed above the graph to correlate the physical impact of the object and the resulting changes in voltage of the sensor.

FIG. 7, like FIG. 4, illustrates the logic that actually determines whether the impact is a ball or foot (or other non-ball object).

Referring to FIG. 8, the entire circuit is illustrated. Sensors 60 are multiplexed via a multiplexor chip 61, which in turn sends signals to the A/D converter 62. A multiplexor is an electronic switch allowing any one of a number of inputs 63 to be selected as output 64 by the use of a different control word from the computer, communicated to the multiplexor via control lines 65. This is processed by the data acquisition software, the logic of which is diagrammatically represented in FIG. 4. The data is then transferred to a personal computer 66. The computer, having processing and memory means, determines whether the impact was a ball or other object.

In operation, the analysis begins with a measurement of the slope of the initial section of the waveform. This slope must also be grater than a pre-set threshold, since a ball has much smaller surface area than a foot and the readings would be unlike each other. If the slope is too gradual, the system indicates this and resets. Next, the waveform is analyzed for its maximum voltage. This measures the force with which the object came into contact with the sensor. If this voltage is greater than a pre-set maximum, the reading also rejected as being a non-ball object, and the system resets after indicating this to the official. The final analysis is the duration of the impact. A foot which comes into contact with the sensor will trip the sensor for a much greater period of time than a ball. The timing operation is measured by a clock internal to the computer. The results are once again displayed on the computer.

The operation of the device is dependent on the measurement of all three of these factors, with each subsequent factor either disposing of the reading as being out of range, or confirming the previous analysis. Only if all three measurements are within the range for a ball will the sensor display a ball impact.

After the analysis has been made, the output is transferred to a graphics package which plots the data on a CRT screen. This provides the illustration of the location of the event which has tripped the sensor. The graphical representation allows enlargement or segmentation of the viewing field for concentration on a specific part of the playing field. If necessary, a light can be provided on the court to signal players of contact with a line.

While I have described a present preferred embodiment of the invention, it is to be distinctly understood that the invention is not limited thereto but may be otherwise embodied and practiced within the scope of the following claims.

I claim:

1. A tape boundary sensor apparatus comprising:

(a) elongated sensor means adapted to be positioned along various boundary lines;

(b) conditioning circuit means electrically connected to the sensor means for filtering out unwanted signals and fluctuations from an output waveform of the sensor means;

(c) multiplexer means electrically connected to the conditioning circuit means for scanning the output of the sensor means for identifying a particular sensor of the sensor means which has been impacted by an object;

(d) analog to digital converter means for converting the analog output waveform of the sensor means to a proportional digital word;

(e) processor and memory means electrically connected to the converter means and to the multiplexer means for comparing the output waveform to known pre-set thresholds of:

(i) slope of the initial section of a known output waveform of the sensor for determination of the surface area of impact;

(ii) peak voltage of a known output waveform of the sensor for determination of the force of impact;

(iii) a known duration of impact; wherein the slope, peak voltage, and duration are compared to the pre-set thresholds to determine and confirm what kind of object impacted the sensor; and (g) indicator means connected to the processor and memory means;

wherein an impact on a sensor causes a voltage output therefrom and the processor makes a determination whether a ball has caused the impact, and directs the results of the analysis to the indicator means.

2. A tape boundary sensor apparatus according to claim 1 wherein said indicator means provides an illustration of said game court on a computer display means and plots the location of the occurrence of an impact at a location on the display corresponding to a location on the game court where the impact occurred.

3. A tape boundary sensor apparatus according to claim 1 further comprising painted boundary lines placed on an upward facing side of the sensor means.

4. A tape boundary sensor apparatus according to claim 1 further comprising tape means provided over said sensor means.

5. A tape boundary sensor apparatus according to claim 1 wherein said sensor means is a piezoelectric sensor.

* * * * *

UNITED STATES PATENT AND TRADEMARK OFFICE

CERTIFICATE OF CORRECTION

PATENT NO. : 4,840,377

DATED : June 20, 1989

INVENTOR(S) : C. Frederick Bowser and John L. Kurtz

It is certified that error appears in the above-identified patent and that said Letters Patent is hereby corrected as shown below:

Column 1 Line 15 after "In" insert --tennis,--.

Column 2 Line 38 "With" should read --with--.

Column 3 Line 38 after "Conductors" insert --1--.

Column 4 Line 2 after "sections" insert --of--.

Column 4 Line 3 after "noise" insert --occurring--.

Signed and Sealed this

Tenth Day of April, 1990

*Attest:*

HARRY F. MANBECK, JR.

*Attesting Officer*

*Commissioner of Patents and Trademarks*